US008619001B2

(12) United States Patent
Wakabayashi

(10) Patent No.: US 8,619,001 B2
(45) Date of Patent: Dec. 31, 2013

(54) MULTI-ANTENNA APPARATUS AND MOBILE DEVICE

(75) Inventor: Naoyuki Wakabayashi, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 419 days.

(21) Appl. No.: 12/956,750

(22) Filed: Nov. 30, 2010

(65) Prior Publication Data

US 2011/0128206 A1 Jun. 2, 2011

(30) Foreign Application Priority Data

Nov. 30, 2009 (JP) ..... 2009-270941

(51) Int. Cl.
*H01Q 1/50* (2006.01)

(52) U.S. Cl.
USPC ..... 343/860

(58) Field of Classification Search
USPC ..... 343/860, 867, 876, 893, 700 MS, 702
See application file for complete search history.

(56) References Cited

U.S. PATENT DOCUMENTS

| | | | | |
|---|---|---|---|---|
| 6,876,331 | B2 | 4/2005 | Chiang et al. | |
| 7,057,574 | B2 * | 6/2006 | Shamir et al. | 343/866 |
| 7,190,313 | B2 | 3/2007 | Chiang et al. | |
| 7,352,328 | B2 | 4/2008 | Moon et al. | |
| 7,446,729 | B2 | 11/2008 | Maruyama et al. | |
| 7,498,997 | B2 | 3/2009 | Moon et al. | |
| 7,530,180 | B2 | 5/2009 | Chiang et al. | |
| 7,557,761 | B2 | 7/2009 | Iwai et al. | |
| 2005/0030233 | A1 * | 2/2005 | Kim et al. | 343/702 |
| 2009/0207092 | A1 * | 8/2009 | Nysen et al. | 343/876 |
| 2009/0213012 | A1 * | 8/2009 | Jiang et al. | 343/700 MS |
| 2009/0277966 | A1 * | 11/2009 | Kato et al. | 235/492 |

FOREIGN PATENT DOCUMENTS

| | | | |
|---|---|---|---|
| JP | 52-106660 | A | 9/1977 |
| JP | 3927918 | B2 | 11/2004 |
| JP | 2005-521289 | A | 7/2005 |
| JP | 2006-93977 | A | 4/2006 |
| JP | 4267003 | B2 | 12/2006 |
| JP | 2007-97167 | A | 4/2007 |
| JP | 2008-199588 | A | 8/2008 |
| JP | 2008-278414 | A | 11/2008 |
| JP | 2009-246560 | A | 10/2009 |

* cited by examiner

*Primary Examiner* — Huedung Mancuso
(74) *Attorney, Agent, or Firm* — Crowell & Moring LLP

(57) ABSTRACT

This multi-antenna apparatus includes a first looped antenna element wound from a first end of the first looped antenna element on a side of a first feeding point in a prescribed direction, a second looped antenna element wound from a first end of the second looped antenna element on a side of a second feeding point in a direction opposite to the prescribed direction, a connecting portion connecting a second end of the first looped antenna element and a second end of the second looped antenna element with each other, and an impedance element arranged between the connecting portion and a ground potential.

18 Claims, 4 Drawing Sheets

MULTI-ANTENNA APPARATUS AND MOBILE DEVICE

BACKGROUND OF THE INVENTION

1. Field of the Invention

The present invention relates to a multi-antenna apparatus and a mobile device, and more particularly, it relates to a multi-antenna apparatus and a mobile device each comprising a plurality of antenna elements.

2. Description of the Background Art

A multi-antenna apparatus comprising a plurality of antenna elements is known in general, as disclosed in Japanese Patent Laying-Open No. 2007-97167, for example.

The aforementioned Japanese Patent Laying-Open No. 2007-97167 discloses a MIMO array antenna (multi-antenna apparatus) comprising two antenna elements each constituted by a monopole antenna and an isolation element arranged between the two antenna elements for reducing a mutual coupling between the two antenna elements. In this MIMO array antenna, the two antenna elements are spaced apart a distance of one half of a wavelength $\lambda$ of the corresponding radio wave from each other and the isolation element is arranged at a position separated from each of the two antenna elements by a distance of $\lambda/4$, thereby resonating the isolation element to reduce the mutual coupling between the antenna elements each constituted by a monopole antenna.

An antenna element constituted by a loop antenna (looped antenna) having characteristics different from those of a linear antenna such as a monopole antenna is known in general, as disclosed in Japanese Patent Laying-Open No. 2006-93977, for example.

The aforementioned Japanese Patent Laying-Open No. 2006-93977 discloses a loop antenna unit comprising a loop antenna having a pair of open edges on both ends thereof and a metal member arranged in the vicinity of the loop antenna, electrically connected to one of the pair of open edges of the loop antenna.

In relation to the MIMO array antenna (multi-antenna apparatus) according to the aforementioned Japanese Patent Laying-Open No. 2007-97167, no structure of reducing a mutual coupling between antenna elements each constituted by a loop antenna is described although the mutual coupling between the antenna elements each constituted by a monopole antenna can be reduced. As hereinabove described, a loop antenna has characteristics different from those of a linear antenna such as a monopole antenna, and hence it is conceivably impossible to apply an art based on the premise of the monopole antenna according to the aforementioned Japanese Patent Laying-Open No. 2007-97167 to the loop antenna described in the aforementioned Japanese Patent Laying-Open No. 2006-93977.

Therefore, in general, it is difficult to reduce a mutual coupling between antenna elements each constituted by a loop antenna when a multi-antenna apparatus is constituted by loop antennas. Consequently, it is disadvantageously difficult to downsize the multi-antenna apparatus including the loop antennas (looped antennas).

SUMMARY OF THE INVENTION

The present invention has been proposed in order to solve the aforementioned problems, and an object of the present invention is to provide a multi-antenna apparatus and a mobile device each allowing downsizing of the multi-antenna apparatus by reducing a mutual coupling between antenna elements each constituted by a loop antenna (looped antenna).

A multi-antenna apparatus according to a first aspect of the present invention comprises a first looped antenna element wound from a first feeding point in a prescribed direction, a second looped antenna element wound from a second feeding point in a direction opposite to the prescribed direction, a connecting portion connecting an end of the first looped antenna element on a side opposite to a side on which the first feeding point is arranged and an end of the second looped antenna element on a side opposite to a side on which the second feeding point is arranged with each other, and an impedance element arranged between the connecting portion and a ground potential. The looped antenna element indicates a wide concept including not only an antenna element formed in the form of a completely closed loop but also an antenna element formed to be partially looped.

As hereinabove described, the multi-antenna apparatus according to the first aspect of the present invention is provided with the first looped antenna element wound from the first feeding point in the prescribed direction and the second looped antenna element wound from the second feeding point in the direction opposite to the prescribed direction, whereby a direction of a voltage generated in the first looped antenna element by a current flowing in the first looped antenna element and a direction of a voltage induced in the second looped antenna element due to the current flowing in the first looped antenna element can be rendered opposite to each other when the current flows in the first looped antenna element. Further, the multi-antenna apparatus is provided with the connecting portion connecting the end of the first looped antenna element on the side opposite to the side on which the first feeding point is arranged and the end of the second looped antenna element on the side opposite to the side on which the second feeding point is arranged with each other and the impedance element arranged between the connecting portion and the ground potential, whereby the direction of the voltage generated in the first looped antenna element by the current flowing in the first looped antenna element and a direction of a voltage generated in the impedance element by a current flowing in the ground potential through the impedance element can be rendered the same as each other when the current flows in the first looped antenna element. Thus, the direction of the voltage generated in the impedance element by the current flowing in the ground potential through the impedance element and the direction of the voltage induced in the second looped antenna element due to the current flowing in the first looped antenna element are opposite to each other when the current flows in the first looped antenna element, and hence at least part of the voltage induced in the second looped antenna element is canceled by the voltage generated in the impedance element. Consequently, a mutual coupling between the first looped antenna element and the second looped antenna element can be reduced. Thus, it is not necessary to increase a distance between the antenna elements to reduce the mutual coupling between the antenna elements each constituted by a looped antenna, and the multi-antenna apparatus with the looped antenna elements can be downsized accordingly.

In the aforementioned multi-antenna apparatus according to the first aspect, a voltage in a direction to cancel a voltage induced in the second looped antenna element due to a current flowing in the first looped antenna element is preferably generated by a current flowing in the ground potential through the impedance element when the current flows in the first looped antenna element at a prescribed frequency. According to this structure, the mutual coupling between the first looped antenna element and the second looped antenna element can be easily reduced by canceling at least part of the voltage induced in the second looped antenna element due to the current flowing in the first looped antenna element by the voltage generated in the impedance element when the current flows in the first looped antenna element.

In this case, the impedance element is preferably formed to have an impedance value at which a voltage having substantially the same magnitude as the voltage induced in the second looped antenna element due to the current flowing in the first looped antenna element is generated by the current flowing in the ground potential through the impedance element when the current flows in the first looped antenna element at the prescribed frequency. According to this structure, substantially all the voltage induced in the second looped antenna element due to the current flowing in the first looped antenna element is canceled by the voltage generated in the impedance element in such a simple way as to set the impedance value of the impedance element to a prescribed value, and hence the mutual coupling between the first looped antenna element and the second looped antenna element can be further reduced. Consequently, the multi-antenna apparatus with the looped antenna elements can be further downsized.

In the aforementioned multi-antenna apparatus according to the first aspect, the first looped antenna element and the second looped antenna element are preferably formed in a substantially U shape, a vicinity of a first end of the first looped antenna element in the substantially U shape is preferably connected to the first feeding point, a vicinity of a first end of the second looped antenna element in the substantially U shape is preferably connected to the second feeding point, and a vicinity of a second end of the first looped antenna element and a vicinity of a second end of the second looped antenna element are preferably connected with each other by the connecting portion while the connecting portion is connected with the impedance element. According to this structure, the multi-antenna apparatus with the simple-shaped and substantially U-shaped looped antenna elements can be downsized.

In the aforementioned multi-antenna apparatus according to the first aspect, the first feeding point is preferably so arranged that a separate distance from the second feeding point is less than a quarter of a wavelength λ of a radio wave output from each of the first looped antenna element and the second looped antenna element. According to this structure, the distance between the first looped antenna element and the second looped antenna element is reduced, and hence the multi-antenna apparatus with the looped antenna elements can be downsized.

The aforementioned multi-antenna apparatus according to the first aspect preferably further comprises a first matching circuit arranged between the first looped antenna element and the first feeding point for inhibiting a mutual coupling between the first looped antenna element and the second looped antenna element while matching impedance at a prescribed frequency, and a second matching circuit arranged between the second looped antenna element and the second feeding point for inhibiting the mutual coupling between the first looped antenna element and the second looped antenna element while matching impedance at the prescribed frequency. According to this structure, the mutual coupling between the first looped antenna element and the second looped antenna element can be reduced while matching impedance at the prescribed frequency, and hence transfer loss of energy transferred through the antenna elements can be further reduced. Thus, gains of the antenna elements each constituted by a looped antenna whose gain is large compared to a linear antenna such as a monopole antenna can be further increased.

In the aforementioned multi-antenna apparatus according to the first aspect, the impedance element is preferably an inductor. According to this structure, the mutual coupling between the first looped antenna element and the second looped antenna element can be easily reduced by the impedance element of an inductor (coil) having a simple structure.

In the aforementioned multi-antenna apparatus according to the first aspect, the first looped antenna element and the second looped antenna element are preferably formed to be bent or curved at a plurality of positions. According to this structure, a length required to arrange the first looped antenna element and the second looped antenna element can be ensured due to bent or curved shapes thereof also when areas where the first looped antenna element and the second looped antenna element are arranged are small, and hence it is not necessary to enlarge the areas where the first looped antenna element and the second looped antenna element are arranged. Thus, the multi-antenna apparatus can be further downsized.

In the aforementioned multi-antenna apparatus according to the first aspect, the first looped antenna element is preferably so arranged that a maximum separate distance from the second looped antenna element is less than a quarter of a wavelength λ of a radio wave output from each of the first looped antenna element and the second looped antenna element. According to this structure, the multi-antenna apparatus with the looped antenna elements can be easily downsized.

The aforementioned multi-antenna apparatus according to the first aspect is preferably formed to be mountable on a mobile device. According to this structure, the small-sized multi-antenna apparatus mountable on the mobile device can be provided.

In the aforementioned multi-antenna apparatus according to the first aspect, the first looped antenna element and the second looped antenna element are preferably formed perpendicular to a straight line connecting the first feeding point and the second feeding point and are formed to be substantially line-symmetric to each other with respect to a straight line passing through a center between the first feeding point and the second feeding point. According to this structure, arrangements of the first looped antenna element and the second looped antenna element can be rendered balanced, and hence gains of the first looped antenna element and the second looped antenna element can be rendered balanced.

In the aforementioned multi-antenna apparatus according to the first aspect, the first looped antenna element and the second looped antenna element are preferably arranged to be electromagnetically coupled with each other. According to this structure, the first looped antenna element and the second looped antenna element can be arranged so close to each other as to be electromagnetically coupled with each other, and hence the multi-antenna apparatus can be downsized.

In the aforementioned multi-antenna apparatus according to the first aspect, the first looped antenna element preferably includes a first portion arranged on a side of the first feeding point, a second portion arranged on a side of the connecting portion and a third portion coupling the first portion and the second portion with each other, the second looped antenna element preferably includes a fourth portion arranged on a side of the second feeding point, a fifth portion arranged on a side of the connecting portion and a sixth portion coupling the fourth portion and the fifth portion with each other, and the second portion of the first looped antenna element and the fifth portion of the second looped antenna element are preferably opposed to each other. According to this structure, the second portion of the first looped antenna element and the fifth portion of the second looped antenna element opposed to each other are connected to the connecting portion, and hence the first looped antenna element and the second looped antenna element can be easily connected with each other.

In this case, the first looped antenna element and the second looped antenna element are preferably so arranged that a separate distance between the second portion of the first looped antenna element and the fifth portion of the second looped antenna element is smaller than a separate distance between the first feeding point and the second feeding point. According to this structure, the distance at which the second portion of the first looped antenna element and the fifth portion of the second looped antenna element are opposed to each other can be reduced, and hence the first looped antenna element and the second looped antenna element can be more easily connected with each other.

In the aforementioned multi-antenna apparatus according to the first aspect, the impedance element is preferably connected with a ground surface in the vicinity of a middle portion between the first feeding point and the second feeding point. According to this structure, gains of the first looped antenna element and the second looped antenna element can be rendered balanced by a simple arrangement in which the impedance element is arranged in the vicinity of the middle portion between the first feeding point and the second feeding point.

A mobile device according to a second aspect of the present invention comprises a multi-antenna apparatus including a first looped antenna element wounded from a first feeding point in a prescribed direction, a second looped antenna element wound from a second feeding point in a direction opposite to the prescribed direction, a connecting portion connecting an end of the first looped antenna element on a side opposite to a side on which the first feeding point is arranged and an end of the second looped antenna element on a side opposite to a side on which the second feeding point is arranged with each other, and an impedance element arranged between the connecting portion and a ground potential.

As hereinabove described, the mobile device according to the second aspect of the present invention is provided with the first looped antenna element wound from the first feeding point in the prescribed direction and the second looped antenna element wound from the second feeding point in the direction opposite to the prescribed direction, whereby a direction of a voltage generated in the first looped antenna element by a current flowing in the first looped antenna element and a direction of a voltage induced in the second looped antenna element due to the current flowing in the first looped antenna element can be rendered opposite to each other when the current flows in the first looped antenna element. Further, the mobile device is provided with the connecting portion connecting the end of the first looped antenna element on the side opposite to the side on which the first feeding point is arranged and the end of the second looped antenna element on the side opposite to the side on which the second feeding point is arranged with each other and the impedance element arranged between the connecting portion and the ground potential, whereby the direction of the voltage generated in the first looped antenna element by the current flowing in the first looped antenna element and a direction of a voltage generated in the impedance element by a current flowing in the ground potential through the impedance element can be rendered the same as each other when the current flows in the first looped antenna element. Thus, the direction of the voltage generated in the impedance element by the current flowing in the ground potential through the impedance element and the direction of the voltage induced in the second looped antenna element due to the current flowing in the first looped antenna element are opposite to each other when the current flows in the first looped antenna element, and hence at least part of the voltage induced in the second looped antenna element is canceled by the voltage generated in the impedance element. Consequently, a mutual coupling between the first looped antenna element and the second looped antenna element can be reduced. Thus, it is not necessary to increase a distance between the antenna elements to reduce the mutual coupling between the antenna elements each constituted by a looped antenna, and the multi-antenna apparatus with the looped antenna elements can be downsized accordingly. Consequently, the mobile device can be downsized.

In the aforementioned mobile device according to the second aspect, a voltage in a direction to cancel a voltage induced in the second looped antenna element due to a current flowing in the first looped antenna element is preferably generated by a current flowing in the ground potential through the impedance element when the current flows in the first looped antenna element at a prescribed frequency. According to this structure, the mutual coupling between the first looped antenna element and the second looped antenna element can be easily reduced by canceling at least part of the voltage induced in the second looped antenna element due to the current flowing in the first looped antenna element by the voltage generated in the impedance element when the current flows in the first looped antenna element.

In this case, the impedance element is preferably formed to have an impedance value at which a voltage having substantially the same magnitude as the voltage induced in the second looped antenna element due to the current flowing in the first looped antenna element is generated by the current flowing in the ground potential through the impedance element when the current flows in the first looped antenna element at the prescribed frequency. According to this structure, substantially all the voltage induced in the second looped antenna element due to the current flowing in the first looped antenna element is canceled by the voltage generated in the impedance element in such a simple way as to set the impedance value of the impedance element to a prescribed value, and hence the mutual coupling between the first looped antenna element and the second looped antenna element can be further reduced. Consequently, the multi-antenna apparatus with the looped antenna elements can be further downsized. Thus, the mobile device can be downsized.

In the aforementioned mobile device according to the second aspect, the first looped antenna element and the second looped antenna element are preferably formed in a substantially U shape, a vicinity of a first end of the first looped antenna element in the substantially U shape is preferably connected to the first feeding point, a vicinity of a first end of the second looped antenna element in the substantially U shape is preferably connected to the second feeding point, and a vicinity of a second end of the first looped antenna element and a vicinity of a second end of the second looped antenna element are preferably connected with each other by the connecting portion while the connecting portion is connected with the impedance element. According to this structure, the multi-antenna apparatus with the simple-shaped and substantially U-shaped looped antenna elements can be downsized. Consequently, the mobile device can be downsized.

In the aforementioned mobile device according to the second aspect, the first feeding point is preferably so arranged that a separate distance from the second feeding point is less than a quarter of a wavelength $\lambda$ of a radio wave output from each of the first looped antenna element and the second looped antenna element. According to this structure, the distance between the first looped antenna element and the second looped antenna element is reduced, and hence the multi-antenna apparatus with the looped antenna elements can be downsized. Consequently, the mobile device can be downsized.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

First, the structure of a mobile phone 100 according to a first embodiment of the present invention is described with reference to FIGS. 1 and 2. The mobile phone 100 is an example of the "mobile device" in the present invention.

Figure 1:
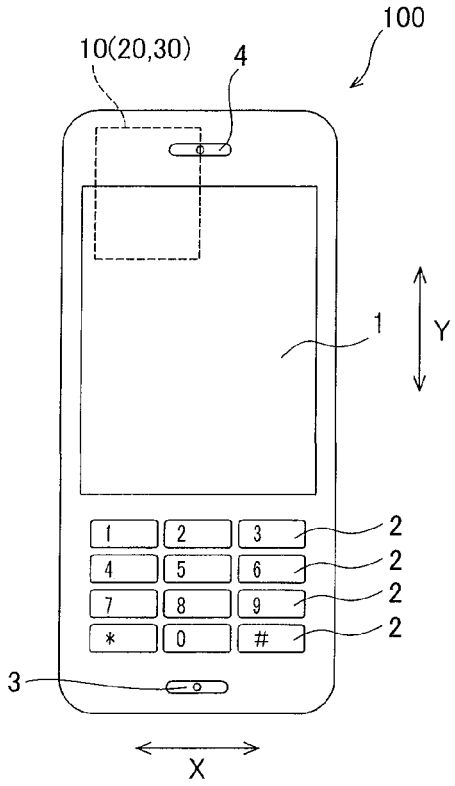
FIG. 1 is a plan view showing the overall structure of a mobile phone according to a first embodiment of the present invention.

The mobile phone 100 according to the first embodiment of the present invention has a substantially rectangular shape in front elevational view, as shown in FIG. 1. The mobile phone 100 comprises a display screen portion 1, operating portions 2 constituted by number buttons and so on, a microphone 3 and a speaker 4. A multi-antenna apparatus 10 is provided inside a housing of the mobile phone 100.

The multi-antenna apparatus 10 is formed for MIMO (Multiple-Input Multiple-Output) communication enabling multiple inputs/outputs at a prescribed frequency employing a plurality of antenna elements. The multi-antenna apparatus 10 corresponds to 1.8 GHz band.

Figure 2:
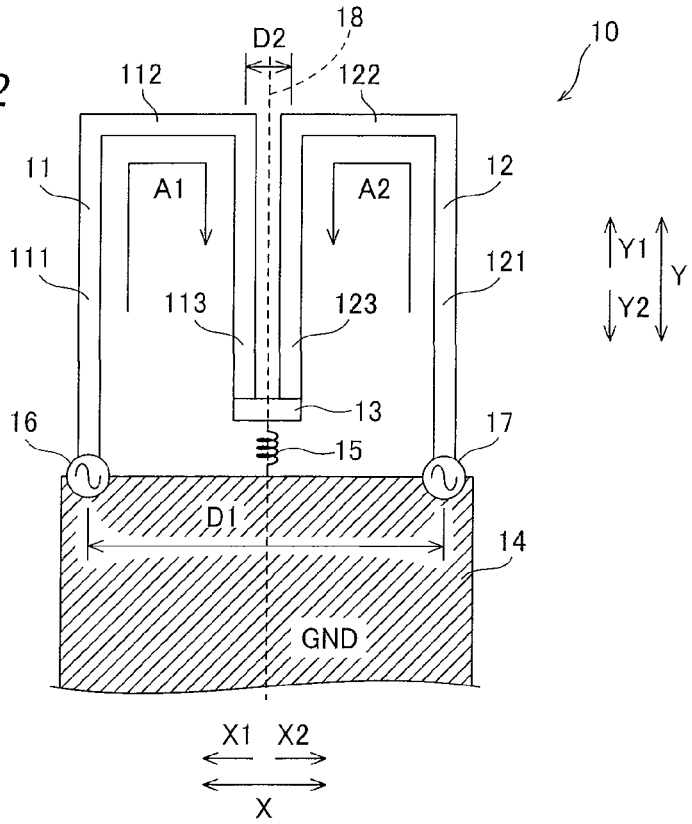
FIG. 2 is a plan view showing a multi-antenna apparatus of the mobile phone according to the first embodiment of the present invention.

The multi-antenna apparatus 10 includes a first looped antenna element 11 serving as a feed element and a second looped antenna element 12 serving as a feed element, a connecting portion 13 connecting the two antenna elements 11 and 12 with each other, a ground surface 14, an impedance element 15 arranged between the connecting portion 13 and the ground surface 14, and a first feeding point 16 for supplying high-frequency power to the first looped antenna element 11 and a second feeding point 17 for supplying high-frequency power to the second looped antenna element 12, as shown in FIG. 2.

The first looped antenna element 11 is arranged adjacent to a side of the second looped antenna element 12 in a direction X1. The first and second looped antenna elements 11 and 12 are arranged at a position where the first and second looped antenna elements 11 and 12 are electromagnetically coupled with each other. The first looped antenna element 11 is formed in a substantially U shape to be wound from the first feeding point 16 in a direction A1. The second looped antenna element 12 is formed in a substantially U shape to be wound from the second feeding point 17 in a direction A2 opposite to the direction A1. More specifically, the substantially U-shaped first looped antenna element 11 (second looped antenna element 12) has a first vertical portion 111 (121) extending in a direction Y1 from the first feeding point 16 (second feeding point 17), a horizontal portion 112 (122) extending in a direction X2 (direction X1) from an end of the first vertical portion 111 (121) in the direction Y1 and a second vertical portion 113 (123) extending in a direction Y2 from an end of the horizontal portion 112 (122) in the direction X2 (direction X1). The first and second looped antenna elements 11 and 12 are formed perpendicular to a straight line connecting the first feeding point 16 and the second feeding point 17 and are formed to be substantially line-symmetric to each other with respect to a straight line 18 passing through a center between the first feeding point 16 and the second feeding point 17. In relation to the first looped antenna element 11 (second looped antenna element 12), an end of the first vertical portion 111 (121) in the direction Y2 is grounded on the ground surface 14 through the first feeding point 16 (second feeding point 17), and an end of the second vertical portion 113 (123) in the direction Y2 is grounded on the ground surface 14 through the connecting portion 13 and the impedance element 15. The first and second looped antenna elements 11 and 12 are so arranged that the second vertical portions 113 and 123 are opposed to each other. The first vertical portions 111 and 121 are examples of the "first portion" and the "fourth portion" in the present invention, respectively, and the second vertical portion 113 and 123 are examples of the "second portion" and the "fifth portion" in the present invention, respectively. The horizontal portions 112 and 122 are examples of the "third portion" and the "sixth portion" in the present invention, respectively.

The first looped antenna element 11 (second looped antenna element 12) has a thin plate shape and is provided on a surface of a substrate (not shown). The first looped antenna element 11 (second looped antenna element 12) has substantially the same electrical length as a wavelength $\lambda$ of 1.8 GHz to which the multi-antenna apparatus 10 corresponds. The electrical length is not a physical length but a length based on delay time of a signal. The first and second looped antenna elements 11 and 12 are arranged in a range of less than $\lambda/4$ along arrow X. More specifically, a separate distance D1 between the first vertical portion 111 of the first looped antenna element 11 arranged at the outermost position in the direction X1 and the first vertical portion 121 of the second looped antenna element 12 arranged at the outermost position in the direction X2 is less than $\lambda/4$. The first and second looped antenna elements 11 and 12 are so arranged that a separate distance D2 between the second vertical portion 113 of the first looped antenna element 11 and the second vertical portion 123 of the second looped antenna element 12 is smaller than the separate distance D1 between the first feeding point 16 and the second feeding point 17.

The connecting portion 13 is made of a conductor and connects an end of the first looped antenna element 11 on a side opposite to a side on which the first feeding point 16 is arranged and an end of the second looped antenna element 12 on a side opposite to a side on which the second feeding point 17 is arranged with each other. More specifically, the connecting portion 13 connects the end of the second vertical portion 113 of the first looped antenna element 11 in the direction Y2 and the end of the second vertical portion 123 of the second looped antenna element 12 in the direction Y2 with each other. The connecting portion 13 is formed to extend along arrow X. The connecting portion 13 is grounded on the ground surface 14 through the impedance element 15. The connecting portion 13 has a thin plate shape and is provided on the surface of the substrate (not shown) similarly to the first looped antenna element 11 (second looped antenna element 12).

The impedance element 15 is arranged between the connecting portion 13 and the ground surface 14. The impedance element 15 is connected with a ground potential in the vicinity of a middle portion between the first feeding point 16 and the second feeding point 17. The impedance element 15 is an inductor (coil). The impedance element 15 is formed to have an impedance value at which a voltage having substantially the same magnitude as a voltage induced in the second looped antenna element 12 (first looped antenna element 11) due to a current flowing in the first looped antenna element 11 (second looped antenna element 12) is generated by a current flowing in the ground surface 14 through the impedance element 15 when the current flows in the first looped antenna element 11 (second looped antenna element 12) at 1.8 GHz to which the multi-antenna apparatus 10 corresponds. At this time, the impedance element 15 is so formed that a voltage in a direction to cancel the voltage induced in the second looped antenna element 12 (first looped antenna element 11) is generated therein.

The first feeding point 16 (second feeding point 17) is arranged on the end of the first vertical portion 111 (121) of the first looped antenna element 11 (second looped antenna element 12) in the direction Y2. The first feeding point 16 (second feeding point 17) connects the first looped antenna element 11 (second looped antenna element 12) and a feeder (not shown) with each other. The first feeding point 16 is so arranged that the separate distance D1 from the second feeding point 17 is less than $\lambda/4$.

According to the first embodiment, as hereinabove described, the multi-antenna apparatus 10 is provided with the first looped antenna element 11 wound from the first feeding point 16 in the direction A1 and the second looped antenna element 12 wound from the second feeding point 17 in the direction A2 opposite to the direction A1, whereby a direction of a voltage generated in the first looped antenna element 11 by the current flowing in the first looped antenna element 11 and a direction of the voltage induced in the second looped antenna element 12 due to the current flowing in the first looped antenna element 11 can be rendered opposite to each other when the current flows in the first looped antenna element 11. Further, the multi-antenna apparatus 10 is provided with the connecting portion 13 connecting the end of the first looped antenna element 11 on the side opposite to the side on which the first feeding point 16 is arranged and the end of the second looped antenna element 12 on the side opposite to the side on which the second feeding point 17 is arranged with each other, and the impedance element 15 arranged between the connecting portion 13 and the ground surface 14, whereby the direction of the voltage generated in the first looped antenna element 11 by the current flowing in the first looped antenna element 11 and a direction of a voltage generated in the impedance element 15 by the current flowing in the ground surface 14 through the impedance element 15 can be rendered the same as each other when the current flows in the first looped antenna element 11. Thus, the direction of the voltage generated in the impedance element 15 by the current flowing in the ground surface 14 through the impedance element 15 and the direction of the voltage induced in the second looped antenna element 12 due to the current flowing in the first looped antenna element 11 are opposite to each other when the current flows in the first looped antenna element 11, and hence at least part of the voltage induced in the second looped antenna element 12 is canceled by the voltage generated in the impedance element 15. Consequently, a mutual coupling between the first looped antenna element 11 and the second looped antenna element 12 can be reduced. Thus, it is not necessary to increase the distance between the antenna elements to reduce the mutual coupling between the antenna elements each constituted by a looped antenna, and the multi-antenna apparatus 10 can be downsized accordingly. Consequently, the mobile phone 100 can be downsized.

According to the first embodiment, the multi-antenna apparatus 10 is so formed that the voltage in the direction to cancel the voltage induced in the second looped antenna element 12 due to the current flowing in the first looped antenna element 11 is generated by the current flowing in the ground surface 14 through the impedance element 15 when the current flows in the first looped antenna element 11 at 1.8 GHz, whereby the mutual coupling between the first looped antenna element 11 and the second looped antenna element 12 can be easily reduced by canceling at least part of the voltage induced in the second looped antenna element 12 due to the current flowing in the first looped antenna element 11 by the voltage generated in the impedance element 15 when the current flows in the first looped antenna element 11.

According to the first embodiment, the impedance element 15 is formed to have an impedance value at which the voltage having substantially the same magnitude as the voltage induced in the second looped antenna element 12 due to the current flowing in the first looped antenna element 11 is generated by the current flowing in the ground surface 14 through the impedance element 15 when the current flows in the first looped antenna element 11 at 1.8 GHz, whereby substantially all the voltage induced in the second looped antenna element 12 due to the current flowing in the first looped antenna element 11 is canceled by the voltage generated in the impedance element 15 in such a simple way as to set the impedance value of the impedance element 15 to a prescribed value, and hence the mutual coupling between the first looped antenna element 11 and the second looped antenna element 12 can be further reduced. Consequently, the multi-antenna apparatus 10 with the looped antenna elements can be further downsized.

According to the first embodiment, the first and second looped antenna elements 11 and 12 are formed in a substantially U shape, a vicinity of a first end of the first looped antenna element 11 in the substantially U shape is connected to the first feeding point 16, a vicinity of a first end of the second looped antenna element 12 in the substantially U shape is connected to the second feeding point 17, a vicinity of a second end of the first looped antenna element 11 and a vicinity of a second end of the second looped antenna element 12 are connected with each other by the connecting portion 13 and the connecting portion 13 is connected with the impedance element 15, whereby the multi-antenna apparatus 10 with the simple-shaped and substantially U-shaped looped antenna elements can be downsized.

According to the first embodiment, the first feeding point 16 is so arranged that a separate distance from the second feeding point 17 is less than a quarter of a wavelength λ of a radio wave output from each of the first looped antenna element 11 and the second looped antenna element 12, whereby the distance between the first looped antenna element 11 and the second looped antenna element 12 is reduced, and hence the multi-antenna apparatus 10 with the looped antenna elements can be downsized.

According to the first embodiment, the impedance element 15 is an inductor (coil), whereby the mutual coupling between the first looped antenna element 11 and the second looped antenna element 12 can be easily reduced by the impedance element 15 of an inductor having a simple structure.

According to the first embodiment, the first looped antenna element 11 is so arranged that a maximum separate distance from the second looped antenna element 12 is less than a quarter of a wavelength λ of a radio wave output from each of the first looped antenna element 11 and the second looped antenna element 12, whereby the multi-antenna apparatus 10 with the looped antenna elements can be easily downsized.

According to the first embodiment, the multi-antenna apparatus 10 is formed to be mountable on the mobile phone 100, whereby the small-sized multi-antenna apparatus 10 mountable on the mobile phone 100 can be provided.

According to the first embodiment, the first and second looped antenna elements 11 and 12 are formed perpendicular to the straight line connecting the first feeding point 16 and the second feeding point 17 and are formed to be substantially line-symmetric to each other with respect to the straight line 18 passing through the center between the first feeding point 16 and the second feeding point 17, whereby arrangements of the first looped antenna element and the second looped antenna element can be rendered balanced, and hence gains of the first looped antenna element 11 and the second looped antenna element 12 can be rendered balanced.

According to the first embodiment, the first looped antenna element 11 and the second looped antenna element 12 are arranged to be electromagnetically coupled with each other, whereby the first looped antenna element 11 and the second looped antenna element 12 can be arranged so close to each other as to be electromagnetically coupled with each other, and hence the multi-antenna apparatus 10 can be downsized.

According to the first embodiment, the first looped antenna element 11 includes the first vertical portion 111 arranged on a side of the first feeding point 16, the second vertical portion 113 arranged on a side of the connecting portion 13 and the horizontal portion 112 coupling the first vertical portion 111 and the second vertical portion 113 with each other, the second looped antenna element 12 includes the first vertical portion 121 arranged on a side of the second feeding point 17, the second vertical portion 123 arranged on a side of the connecting portion 13 and the horizontal portion 122 coupling the first vertical portion 121 and the second vertical portion 123 with each other and the second vertical portion 113 of the first looped antenna element 11 and the second vertical portion 123 of the second looped antenna element 12 are opposed to each other, whereby the second vertical portion 113 of the first looped antenna element 11 and the second vertical portion 123 of the second looped antenna element 12 opposed to each other are connected to the connecting portion, and hence the first looped antenna element 11 and the second looped antenna element 12 can be easily connected with each other.

According to the first embodiment, the first looped antenna element 11 and the second looped antenna element 12 are so arranged that the separate distance between the second vertical portion 113 of the first looped antenna element 11 and the second vertical portion 123 of the second looped antenna element 12 is smaller than the separate distance between the first feeding point 16 and the second feeding point 17, whereby a distance at which the second vertical portion 113 of the first looped antenna element 11 and the second vertical portion 123 of the second looped antenna element 12 are opposed to each other can be reduced, and hence the first looped antenna element 11 and the second looped antenna element 12 can be more easily connected with each other.

According to the first embodiment, the impedance element 15 is connected with the ground surface 14 in the vicinity of the middle portion between the first feeding point 16 and the second feeding point 17, whereby gains of the first looped antenna element 11 and the second looped antenna element 12 can be rendered balanced by a simple arrangement in which the impedance element 15 is arranged in the vicinity of the middle portion between the first feeding point 16 and the second feeding point 17.

Next, results of a simulation performed for confirming the aforementioned effects of the first embodiment are described.

In the multi-antenna apparatus 10 corresponding to the first embodiment shown in FIG. 2, the first looped antenna element 11 and the second looped antenna element 12 are so arranged that the separate distance D1 is 32 mm less than λ/4. Further, the first looped antenna element 11 and the second looped antenna element 12 are so arranged that the center-to-center distance D2 between the second vertical portion 113 of the first looped antenna element 11 and the second vertical portion 123 of the second looped antenna element 12 is 4 mm. While the first looped antenna element 11, the second looped antenna element 12 and the connecting portion 13 are provided on the surface of the substrate (not shown) in the aforementioned first embodiment, the first looped antenna element 11, the second looped antenna element 12 and the connecting portion 13 are provided in a vacuum in this simulation. In order to perform the simulation by a system corresponding to two dimensions, the first looped antenna element 11, the second looped antenna element 12 and the connecting portion 13 are formed of a conductor having a thickness of 0 mm.

Figure 3:
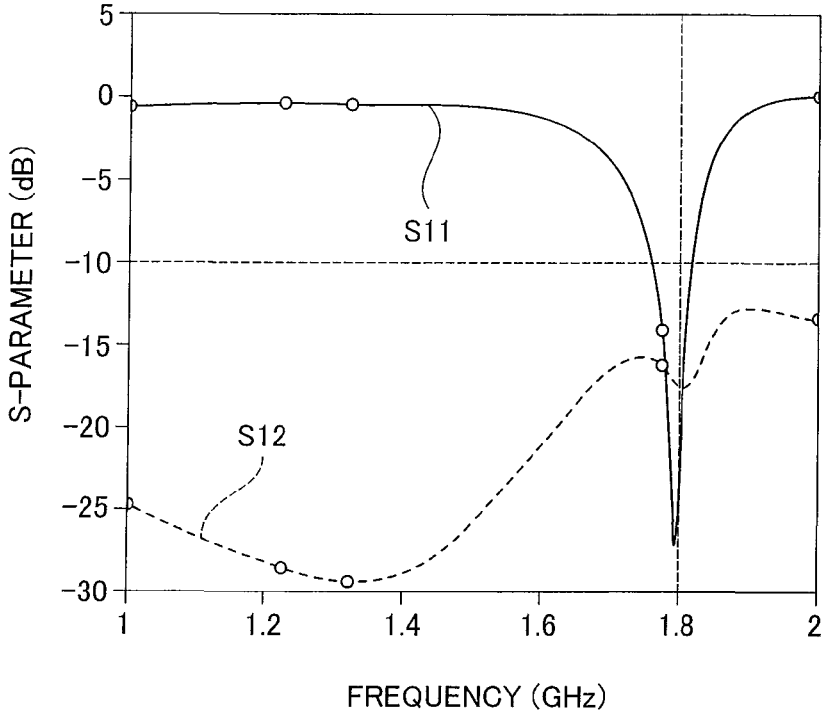
FIG. 3 is a diagram showing S-parameter characteristics of the multi-antenna apparatus corresponding to the first embodiment of the present invention in a simulation.

Next, S-parameter characteristics of the multi-antenna apparatus 10 corresponding to the first embodiment are described with reference to FIG. 3. S11 of S-parameters shown in FIG. 3 denotes reflection coefficients of an antenna element, and S12 of the S-parameters denotes strength of a mutual coupling between two antenna elements. In FIG. 3, the axis of abscissas shows frequencies, and the axis of ordinates shows magnitude (unit: dB) of S11 and S12.

In the multi-antenna apparatus 10 corresponding to the first embodiment, as shown in FIG. 3, S11 is about −24 dB and S12 is about −17.5 dB at 1.8 GHz to which the multi-antenna apparatus 10 corresponds.

Consequently, a value of S12 of the multi-antenna apparatus 10 corresponding to the first embodiment is smaller than −10 dB at which a mutual coupling between antenna elements would be considered to be fairly small, and hence it has been proved possible to reduce the mutual coupling between the antenna elements by connecting the first looped antenna element 11 and the second looped antenna element 12 with each other by the connecting portion 13 and providing the impedance element 13 between the connecting portion 13 and the ground surface 14.

This is conceivably for the following reason. In other words, in the multi-antenna apparatus 10 corresponding to the first embodiment, at least part of the voltage induced in the second looped antenna element 12 due to the current flowing in the first looped antenna element 11 is canceled by the voltage generated in the impedance element 15 by the current flowing in the ground surface 14 through the impedance element 15 at 1.8 GHz to which the multi-antenna apparatus 10 corresponds, whereby the mutual coupling between the first looped antenna element 11 and the second looped antenna element 12 is conceivably reduced.

Further, in the multi-antenna apparatus 10 corresponding to the first embodiment, as shown in FIG. 3, S11 denoting reflection coefficients of an antenna element is −24 dB, which is relatively small, at 1.8 GHz to which the multi-antenna apparatus 10 corresponds, and hence it has been proved possible to output radio waves efficiently from the antenna elements.

Second Embodiment

A multi-antenna apparatus 20 of a mobile phone 100 according to a second embodiment of the present invention is now described with reference to FIG. 4. In this second embodiment, the multi-antenna apparatus 20 in which a second vertical portion 213 of a first looped antenna element 21 and a second vertical portion 223 of a second looped antenna element 22 are formed to be bent at a plurality of positions is described, dissimilarly to the aforementioned first embodiment.

Figure 4:
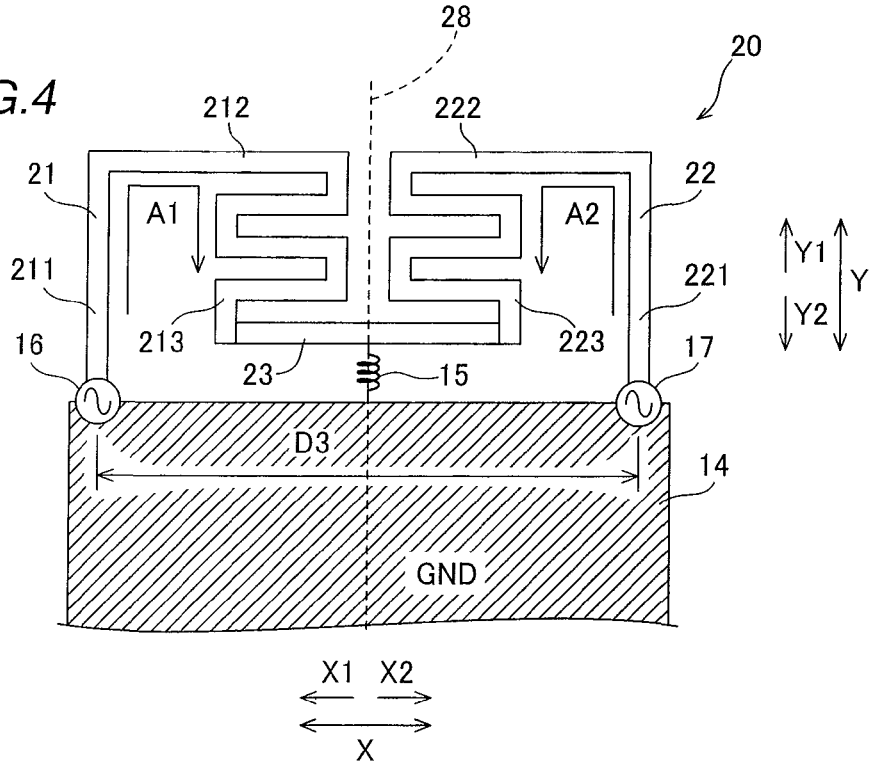
FIG. 4 is a plan view showing a multi-antenna apparatus of a mobile phone according to a second embodiment of the present invention.

As shown in FIG. 4, the multi-antenna apparatus 20 of the mobile phone 100 according to the second embodiment includes the first looped antenna element 21 serving as a feed element and the second looped antenna element 22 serving as a feed element, a connecting portion 23 connecting the two antenna elements 21 and 22 with each other, a ground surface 14, an impedance element 15 arranged between the connecting portion 23 and the ground surface 14, and a first feeding point 16 for supplying high-frequency power to the first looped antenna element 21 and a second feeding point 17 for supplying high-frequency power to the second looped antenna element 22.

The first looped antenna element 21 is arranged adjacent to a side of the second looped antenna element 22 in a direction X1. The first and second looped antenna elements 21 and 22 are arranged at a position where the first and second looped antenna elements 21 and 22 are electromagnetically coupled with each other. The first looped antenna element 21 is formed in a substantially U shape to be wound from the first feeding point 16 in a direction A1. The second looped antenna element 22 is formed in a substantially U shape to be wound from the second feeding point 17 in a direction A2 opposite to the direction A1. More specifically, the first looped antenna element 21 (second looped antenna element 22) has a first vertical portion 211 (221) extending in a direction Y1 from the first feeding point 16 (second feeding point 17), a horizontal portion 212 (222) extending in a direction X2 (direction X1) from an end of the first vertical portion 211 (221) in the direction Y1 and the second vertical portion 213 (223) connecting an end of the horizontal portion 212 (222) in the direction X2 (direction X1) and an end of the connecting portion 23 in the direction X1 (direction X2) with each other. The first vertical portions 211 and 221 are examples of the "first portion" and the "fourth portion" in the present invention, respectively, and the second vertical portion 213 and 223 are examples of the "second portion" and the "fifth portion" in the present invention, respectively. The horizontal portions 212 and 222 are examples of the "third portion" and the "sixth portion" in the present invention, respectively.

According to the second embodiment, the second vertical portion 213 (223) is formed to be bent at the plurality of positions. An end of the second vertical portion 213 (223) in the direction Y1 is arranged at a position deviating in the direction X2 (direction X1) with respect to an end thereof in a direction Y2, dissimilarly to the aforementioned first embodiment. The first and second looped antenna elements 21 and 22 are formed perpendicular to a straight line connecting the first feeding point 16 and the second feeding point 17 and are formed to be substantially line-symmetric to each other with respect to a straight line 28 passing through a center between the first feeding point 16 and the second feeding point 17. In relation to the first looped antenna element 21 (second looped antenna element 22), an end of the first vertical portion 211 (221) in the direction Y2 is grounded on the ground surface 14 through the first feeding point 16 (second feeding point 17), and the end of the second vertical portion 213 (223) in the direction Y2 is grounded on the ground surface 14 through the connecting portion 23 and the impedance element 15. The first and second looped antenna elements 21 and 22 are so arranged that the second vertical portions 213 and 223 are opposed to each other.

The first looped antenna element 21 (second looped antenna element 22) has a thin plate shape and is provided on a surface of a substrate (not shown). The first looped antenna element 21 (second looped antenna element 22) has substantially the same electrical length as a wavelength 2 of 1.8 GHz to which the multi-antenna apparatus 20 corresponds. The first and second looped antenna elements 21 and 22 are arranged in a range of less than $\lambda/4$ along arrow X. More specifically, a separate distance D3 between the first vertical portion 211 of the first looped antenna element 21 arranged at the outermost position in the direction X1 and the first vertical portion 221 of the second looped antenna element 22 arranged at the outermost position in the direction X2 is less than $\lambda/4$.

The connecting portion 23 connects the end of the second vertical portion 213 of the first looped antenna element 21 in the direction Y2 and the end of the second vertical portion 223 of the second looped antenna element 22 in the direction Y2 with each other. The connecting portion 23 is formed to extend along arrow X. The connecting portion 23 is grounded on the ground surface 14 through the impedance element 15. The connecting portion 23 has a thin plate shape and is provided on the surface of the substrate (not shown) similarly to the first looped antenna element 21 (second looped antenna element 22).

The remaining structure of the second embodiment is similar to that of the aforementioned first embodiment.

As hereinabove described, also in the structure of the second embodiment, a mutual coupling between the first looped antenna element 21 and the second looped antenna element 22 can be reduced, similarly to the aforementioned first embodiment. Thus, it is not necessary to increase the distance between the antenna elements to reduce the mutual coupling between the antenna elements each constituted by a looped antenna, and the multi-antenna apparatus 20 with the looped antenna elements can be downsized accordingly.

According to the second embodiment, as hereinabove described, the second vertical portion 213 of the first looped antenna element 21 and the second vertical portion 223 of the second looped antenna element 22 are formed to be bent at the plurality of positions, whereby a length required to arrange the first looped antenna element 21 and the second looped antenna element 22 can be ensured due to bent shapes thereof also when areas where the first looped antenna element 21 and the second looped antenna element 22 are arranged are small, and hence it is not necessary to enlarge the areas where the first looped antenna element 21 and the second looped antenna element 22 are arranged. Thus, the multi-antenna apparatus 20 can be downsized.

The remaining effects of the second embodiment are similar to those of the aforementioned first embodiment.

Third Embodiment

A multi-antenna apparatus 30 of a mobile phone 100 according to a third embodiment of the present invention is now described with reference to FIG. 5. In this third embodiment, the multi-antenna apparatus 30 including a first matching circuit 31 arranged between a first looped antenna element 11 and a first feeding point 16 and a second matching circuit 32 arranged between a second looped antenna element 12 and a second feeding point 17 is described, dissimilarly to the aforementioned first embodiment.

Figure 5:
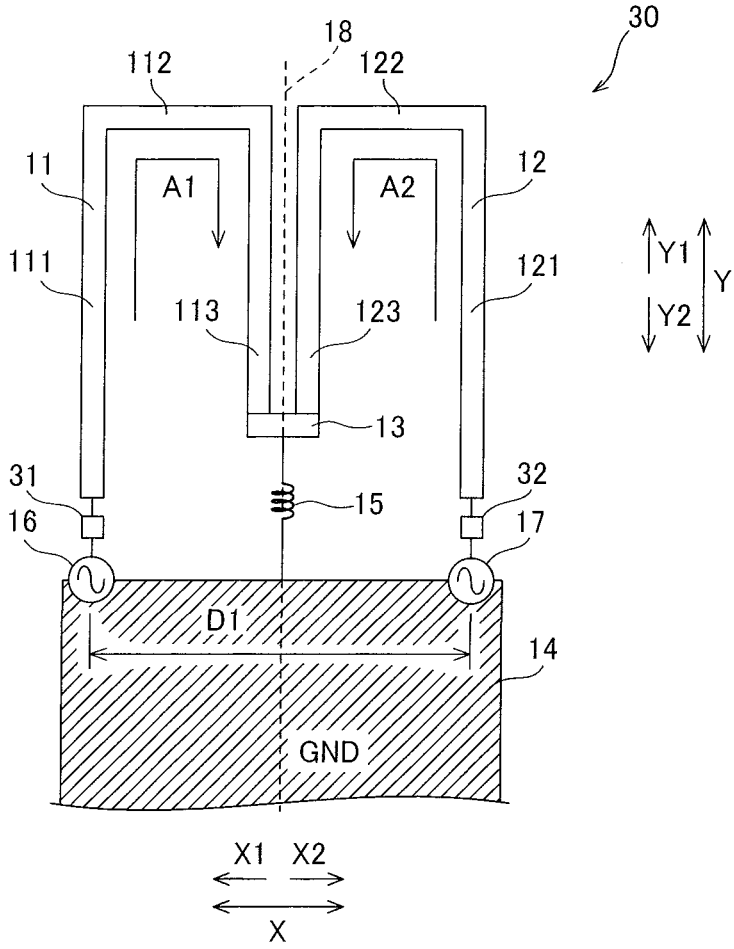
FIG. 5 is a plan view showing a multi-antenna apparatus of a mobile phone according to a third embodiment of the present invention.

The multi-antenna apparatus 30 of the mobile phone 100 according to the third embodiment includes the first matching circuit 31 arranged between the first looped antenna element 11 and the first feeding point 16 and the second matching circuit 32 arranged between the second looped antenna element 12 and the second feeding point 17, as shown in FIG. 5.

Figure 6:
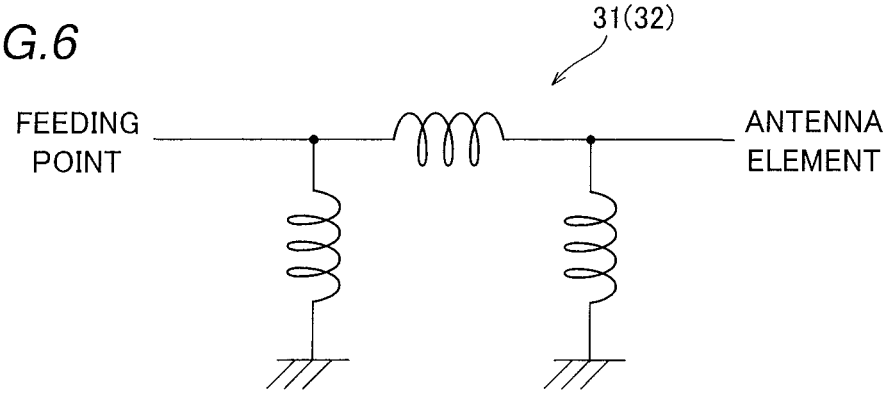
FIG. 6 is a diagram showing a matching circuit of the multi-antenna apparatus of the mobile phone according to the third embodiment of the present invention.

The first matching circuit 31 (second matching circuit 32) has a function of reducing transfer loss of energy by impedance matching at 1.8 GHz to which the multi-antenna apparatus 30 corresponds. The first matching circuit 31 (second matching circuit 32) is provided for inhibiting a mutual coupling between the antenna elements while matching impedance at 1.8 GHz to which the multi-antenna apparatus 30 corresponds. More specifically, impedance of the first matching circuit 31 (second matching circuit 32) is adjusted, whereby a minimum value of S12 denoting strength of a mutual coupling between two antenna elements can be easily located in the vicinity of a desired frequency. The first matching circuit 31 (second matching circuit 32) is constituted by a $\pi$ circuit ($\pi$ match) made of an inductor (coil), as shown in FIG. 6.

The remaining structure of the third embodiment is similar to that of the aforementioned first embodiment.

As hereinabove described, also in the structure of the third embodiment, the mutual coupling between the first looped antenna element 11 and the second looped antenna element 12 can be reduced, similarly to the aforementioned first embodiment. Thus, it is not necessary to increase a distance between the antenna elements to reduce the mutual coupling between the antenna elements each constituted by a looped antenna, and the multi-antenna apparatus 30 with the looped antenna elements can be downsized accordingly.

According to the third embodiment, as hereinabove described, the first matching circuit 31 arranged between the first looped antenna element 11 and the first feeding point 16 for inhibiting the mutual coupling between the first looped antenna element 11 and the second looped antenna element 12 while matching impedance at 1.8 GHz and the second matching circuit 32 arranged between the second looped antenna element 12 and the second feeding point 17 for inhibiting the mutual coupling between the first looped antenna element 11 and the second looped antenna element 12 while matching impedance at 1.8 GHz are provided, whereby the mutual coupling between the first looped antenna element 11 and the second looped antenna element 12 can be reduced while matching impedance at 1.8 GHz, and hence transfer loss of energy transferred through the antenna elements can be further reduced. Thus, gains of the antenna elements each constituted by a looped antenna whose gain is large compared to a linear antenna such as a monopole antenna can be further increased.

The remaining effects of the third embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while the mobile phone is shown as an exemplary mobile device comprising a multi-antenna apparatus in each of the aforementioned first to third embodiments, the present invention is not restricted to this. The present invention is also applicable to another mobile device other than the mobile phone, such as a PDA (Personal Digital Assistant) or a small-sized notebook computer comprising a multi-antenna apparatus. Alternatively, the present invention is also applicable to another device, other than the mobile device, comprising a multi-antenna apparatus.

While the multi-antenna apparatus for MIMO communication is shown as an exemplary multi-antenna apparatus in each of the aforementioned first to third embodiments, the present invention is not restricted to this. In the present invention, a multi-antenna apparatus corresponding to another system other than MIMO, such as Diversity may be employed.

While the multi-antenna apparatus is formed to correspond to 1.8 GHz band in each of the aforementioned first to third embodiments, the present invention is not restricted to this. In the present invention, the multi-antenna apparatus may be formed to correspond to a frequency other than 1.8 GHz band, for example.

While the connecting portion connects the end of the first looped antenna element on the side opposite to the side on which the first feeding point is arranged and the end of the second looped antenna element on the side opposite to the side on which the second feeding point is arranged with each other in each of the aforementioned first to third embodiments, the present invention is not restricted to this. In the present invention, another parts of the first looped antenna element and the second looped antenna element other than the ends thereof may be connected with each other, so far as the connecting portion connects the end of the first looped antenna element on the side opposite to the side on which the first feeding point is arranged and the end of the second looped antenna element on the side opposite to the side on which the second feeding point is arranged with each other.

While the impedance element is an inductor (coil) in each of the aforementioned first to third embodiments, the present invention is not restricted to this. In the present invention, the impedance element may be a capacitor (condenser) or may include both an inductor (coil) and a capacitor (condenser).

While the impedance element is formed to have an impedance value at which the voltage having substantially the same magnitude as the voltage induced in the second looped antenna element (first looped antenna element) due to the current flowing in the first looped antenna element (second looped antenna element) is generated by the current flowing in the ground surface through the impedance element when the current flows in the first looped antenna element (second looped antenna element) in each of the aforementioned first to third embodiments, the present invention is not restricted to this. In the present invention, it is not necessary to adjust the magnitude of a voltage generated by the current flowing in the ground surface through the impedance element, so far as the voltage in the direction to cancel the voltage induced in the second looped antenna element (first looped antenna element) is generated by the current flowing in the ground surface through the impedance element.

While the two antenna elements are provided on the multi-antenna apparatus in each of the aforementioned first to third embodiments, the present invention is not restricted to this. In the present invention, more than two antenna elements may be provided so far as there are a plurality of antenna elements.

Figure 7:
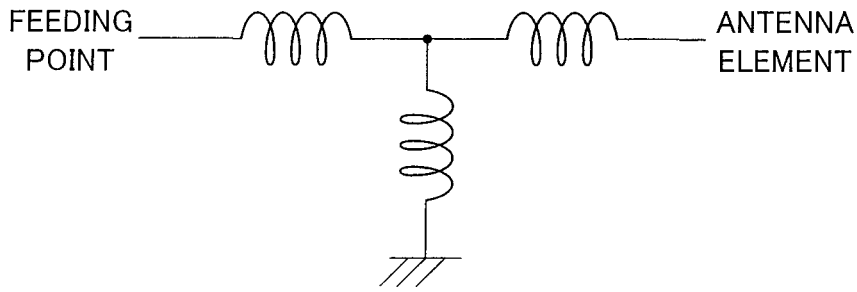
FIG. 7 schematically illustrates a T matching circuit according to a modification of the third embodiment of the present invention.
Figure 8:
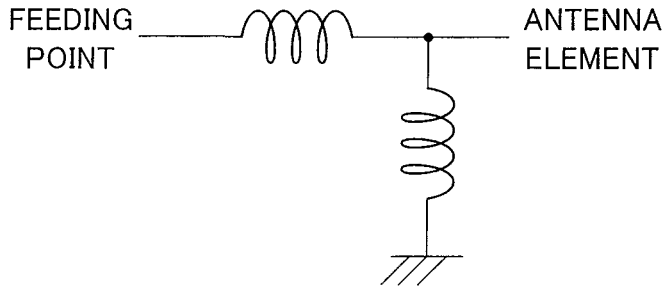
FIG. 8 schematically illustrates an L matching circuit according to another modification of the third embodiment of the present invention.

While the first matching circuit (second matching circuit) constituted by the πcircuit (π match) made of an inductor (coil) is provided in the aforementioned third embodiment, the present invention is not restricted to this. In the present invention, a first matching circuit (second matching circuit) formed in another shape other than the π circuit, such as a T circuit (T match) made of an inductor (coil) shown in FIG. 7 or an L circuit (L match) made of an inductor (coil) shown in FIG. 8 may be provided. Alternatively, the π circuits, the T circuits, the L circuits or the like may be made of only either an inductor (coil) or a capacitor (condenser) or may be made of both an inductor (coil) and a capacitor (condenser).

While the second vertical portion of the first looped antenna element (second looped antenna element) is formed to be bent at the plurality of positions in the aforementioned second embodiment, the present invention is not restricted to this. In the present invention, the second vertical portion of the first looped antenna element (second looped antenna element) may be formed to be curved at a plurality of positions. Alternatively, in the present invention, the first vertical portion and the horizontal portion other than the second vertical portion of the first looped antenna element (second looped antenna element) may be formed to be bent or curved at a plurality of positions.

While the connecting portion is formed to extend along arrow X in each of the aforementioned first to third embodiments, the present invention is not restricted to this. In the present invention, the connecting portion may be formed to be bent or curved at a plurality of positions.

While the first looped antenna element (second looped antenna element) is formed to be partially looped (not to be completely closed) in each of the aforementioned first to third embodiments, the present invention is not restricted to this. In the present invention, the first looped antenna element (second looped antenna element) may be formed in the form of a completely closed loop.

What is claimed is:

1. A multi-antenna apparatus comprising:

a first looped antenna element wound from a first feeding point in a prescribed direction;

a second looped antenna element wound from a second feeding point in a direction opposite to said prescribed direction;

a connecting portion connecting a vicinity of an end of said first looped antenna element on a side opposite to a side on which said first feeding point is arranged and a vicinity of an end of said second looped antenna element on a side opposite to a side on which said second feeding point is arranged; and an impedance element arranged between said connecting portion and a ground potential, wherein a voltage in a direction to cancel a voltage induced in said second looped antenna element due to a current flowing in said first looped antenna element is generated by a current flowing in said ground potential through said impedance element when the current flows in said first looped antenna element at a prescribed frequency.

2. The multi-antenna apparatus according to claim 1, wherein said impedance element is formed to have an impedance value at which a voltage having substantially the same magnitude as the voltage induced in said second looped antenna element due to the current flowing in said first looped antenna element is generated by the current flowing in said ground potential through said impedance element when the current flows in said first looped antenna element at said prescribed frequency.

3. The multi-antenna apparatus according to claim 1, wherein said first looped antenna element and said second looped antenna element are formed in a substantially U shape, a vicinity of a first end of said first looped antenna element in said substantially U shape is connected to said first feeding point, a vicinity of a first end of said second looped antenna element in said substantially U shape is connected to said second feeding point, and a vicinity of a second end of said first looped antenna element and a vicinity of a second end of said second looped antenna element are connected with each other by said connecting portion while said connecting portion is connected with said impedance element.

4. The multi-antenna apparatus according to claim 1, wherein said first feeding point is so arranged that a separate distance from said second feeding point is less than a quarter of a wavelength λ of a radio wave output from each of said first looped antenna element and said second looped antenna element.

5. The multi-antenna apparatus according to claim 1, further comprising:

a first matching circuit arranged between said first looped antenna element and said first feeding point for inhibiting a mutual coupling between said first looped antenna element and said second looped antenna element while matching impedance at a prescribed frequency; and a second matching circuit arranged between said second looped antenna element and said second feeding point for inhibiting the mutual coupling between said first looped antenna element and said second looped antenna element while matching impedance at the prescribed frequency.

6. The multi-antenna apparatus according to claim 1, wherein said impedance element is an inductor.

7. The multi-antenna apparatus according to claim 1, wherein said first looped antenna element and said second looped antenna element are formed to be bent or curved at a plurality of positions.

8. The multi-antenna apparatus according to claim 1, wherein said first looped antenna element is so arranged that a maximum separate distance from said second looped antenna element is less than a quarter of a wavelength λ of a radio wave output from each of said first looped antenna element and said second looped antenna element.

9. The multi-antenna apparatus according to claim 1, formed to be mountable on a mobile device.

10. The multi-antenna apparatus according to claim 1, wherein said first looped antenna element and said second looped antenna element are formed perpendicular to a straight line connecting said first feeding point and said second feeding point and are formed to be substantially line-symmetric to each other with respect to a straight line passing through a center between said first feeding point and said second feeding point.

11. The multi-antenna apparatus according to claim 1, wherein said first looped antenna element and said second looped antenna element are arranged to be electromagnetically coupled with each other.

12. The multi-antenna apparatus according to claim 1, wherein said first looped antenna element includes a first portion arranged on a side of said first feeding point, a second portion arranged on a side of said connecting portion and a third portion coupling said first portion and said second portion with each other, said second looped antenna element includes a fourth portion arranged on a side of said second feeding point, a fifth portion arranged on a side of said connecting portion and a sixth portion coupling said fourth portion and said fifth portion with each other, and said second portion of said first looped antenna element and said fifth portion of said second looped antenna element are opposed to each other.

13. The multi-antenna apparatus according to claim 12, wherein said first looped antenna element and said second looped antenna element are so arranged that a separate distance between said second portion of said first looped antenna element and said fifth portion of said second looped antenna element is smaller than a separate distance between said first feeding point and said second feeding point.

14. The multi-antenna apparatus according to claim 1, wherein said impedance element is connected with a ground surface in the vicinity of a middle portion between said first feeding point and said second feeding point.

15. A mobile device comprising a multi-antenna apparatus including:

a first looped antenna element wounded from a first feeding point in a prescribed direction;

a second looped antenna element wound from a second feeding point in a direction opposite to said prescribed direction;

a connecting portion connecting a vicinity of an end of said first looped antenna element on a side opposite to a side on which said first feeding point is arranged and a vicinity of an end of said second looped antenna element on a side opposite to a side on which said second feeding point is arranged; and an impedance element arranged between said connecting portion and a ground potential, wherein a voltage in a direction to cancel a voltage induced in said second looped antenna element due to a current flowing in said first looped antenna element is generated by a current flowing in said ground potential through said impedance element when the current flows in said first looped antenna element at a prescribed frequency.

16. The mobile device according to claim 15, wherein said impedance element is formed to have an impedance value at which a voltage having substantially the same magnitude as the voltage induced in said second looped antenna element due to the current flowing in said first looped antenna element is generated by the current flowing in said ground potential through said impedance element when the current flows in said first looped antenna element at said prescribed frequency.

17. The mobile device according to claim 15, wherein said first looped antenna element and said second looped antenna element are formed in a substantially U shape, a vicinity of a first end of said first looped antenna element in said substantially U shape is connected to said first feeding point, a vicinity of a first end of said second looped antenna element in said substantially U shape is connected to said second feeding point, and a vicinity of a second end of said first looped antenna element and a vicinity of a second end of said second looped antenna element are connected with each other by said connecting portion while said connecting portion is connected with said impedance element.

18. The mobile device according to claim 15, wherein said first feeding point is so arranged that a separate distance from said second feeding point is less than a quarter of a wavelength $\lambda$ of a radio wave output from each of said first looped antenna element and said second looped antenna element.

* * * * *